US008176710B2

(12) United States Patent
Davidson, III et al.

(10) Patent No.: US 8,176,710 B2
(45) Date of Patent: May 15, 2012

(54) FRAME MEMBER EXTENDER AND METHOD FOR FORMING THE SAME

(75) Inventors: George G. Davidson, III, Bozeman, MT (US); Kent R. Preszler, Bozeman, MT (US)

(73) Assignee: Eclip, LLC, Bozeman, MT (US)

( * ) Notice: Subject to any disclaimer, the term of this patent is extended or adjusted under 35 U.S.C. 154(b) by 1073 days.

(21) Appl. No.: 12/036,340

(22) Filed: Feb. 25, 2008

(65) Prior Publication Data

US 2008/0216439 A1 Sep. 11, 2008

Related U.S. Application Data

(60) Provisional application No. 60/893,692, filed on Mar. 8, 2007.

(51) Int. Cl.
*E04C 2/34* (2006.01)
*E04C 3/00* (2006.01)

(52) U.S. Cl. ..... 52/856; 52/846; 52/836; 52/481.1

(58) Field of Classification Search ..... 52/836, 52/846, 847, 856, 481.1
See application file for complete search history.

(56) References Cited

U.S. PATENT DOCUMENTS 633,622 A * 9/1899 Souther ..... 52/57
701,376 A * 6/1902 Noel ..... 52/57
D42,536 S * 5/1912 Jay et al. ..... D25/119
D42,537 S * 5/1912 Jay et al. ..... D25/119
1,365,059 A * 1/1921 Piccirilli ..... 52/783.11
1,453,996 A * 5/1923 Riddle ..... 52/376
1,475,409 A * 11/1923 Riddle ..... 52/376
1,741,423 A * 12/1929 Lachman ..... 52/636
1,755,503 A * 4/1930 Collins ..... 52/354
1,900,767 A * 3/1933 Ryan ..... 52/354
1,933,221 A * 10/1933 Rockhoff ..... 52/481.1
2,154,944 A * 4/1939 Kullmer ..... 52/376
2,178,388 A * 10/1939 Beckman ..... 52/514
2,762,472 A * 9/1956 Jackson ..... 52/579
3,008,273 A * 11/1961 Widin ..... 52/85
3,330,700 A * 7/1967 Sequeira et al. ..... 136/244
3,807,103 A * 4/1974 Kautz et al. ..... 52/58
4,016,700 A 4/1977 Blomstedt (Continued)

OTHER PUBLICATIONS

ETC, Inc.; "August News Release", 2006, downloaded from URL: http://www.insul-stud.com/august_news.htm.

*Primary Examiner* — Robert Canfield
*Assistant Examiner* — Charissa Ahmad
(74) *Attorney, Agent, or Firm* — Michael J. Weins; Jeffrey E. Semprebon

(57) ABSTRACT

A frame extender for attachment to a stud is formed as an L-shaped body having two orthogonal legs, a short leg and a long leg. The short leg serves as a mounting surface to which a wall surfacing material can be attached, while the long leg is fastened to the stud. The long leg terminates in an outer edge which preferably has a toothed profile. An indexing mark is provided on the long leg, extending parallel to the short leg and spaced apart therefrom, and substantially traversing the long leg. The indexing mark is preferably provided by a discontinuity in the surface of the long leg that is placed against the stud. A preferred method for fabricating the frame extenders uses stock that can be pressed or extruded, and which is cut along a serpentine path to form a pair of frame extenders.

20 Claims, 9 Drawing Sheets

U.S. PATENT DOCUMENTS 4,364,212 A * 12/1982 Pearson et al. ..... 52/281
4,435,936 A * 3/1984 Rutkowski ..... 52/481.1
4,466,225 A 8/1984 Hovind
4,862,667 A * 9/1989 Melland ..... 52/847
5,024,039 A * 6/1991 Karhumaki ..... 52/489.2
5,092,100 A 3/1992 Lambert et al.
5,207,045 A * 5/1993 Bodnar ..... 52/600
5,291,717 A * 3/1994 Turner ..... 52/745.07
5,321,921 A * 6/1994 Holt ..... 52/97
5,321,924 A * 6/1994 Smolik ..... 52/204.1
5,377,472 A 1/1995 Terenzoni
5,390,457 A * 2/1995 Sjolander ..... 52/387
5,669,197 A * 9/1997 Bodnar ..... 52/636
5,671,583 A * 9/1997 Turner ..... 52/745.16
5,720,144 A * 2/1998 Knudson et al. ..... 52/481.1
5,725,201 A * 3/1998 Parth ..... 256/24
D407,831 S * 4/1999 Gifford ..... D25/136
5,904,023 A * 5/1999 diGirolamo et al. ..... 52/712
6,119,420 A * 9/2000 Koenig et al. ..... 52/255
6,122,888 A * 9/2000 Bodnar ..... 52/745.05
6,148,579 A * 11/2000 Rolf ..... 52/639
6,158,190 A 12/2000 Seng
6,185,824 B1 * 2/2001 McClure et al. ..... 30/229
6,243,995 B1 * 6/2001 Reeves et al. ..... 52/94
6,363,682 B1 4/2002 Cowley
6,412,248 B1 7/2002 Rudd
6,421,972 B1 7/2002 Dalphond et al.
6,523,315 B2 * 2/2003 Ford ..... 52/514
6,550,190 B2 * 4/2003 Ruiz et al. ..... 52/169.5
6,584,743 B2 * 7/2003 Paxton et al. ..... 52/312
6,607,168 B1 * 8/2003 Cordier et al. ..... 244/199.1
6,615,563 B1 * 9/2003 Nanayakkara ..... 52/846
6,634,155 B2 * 10/2003 Smith ..... 52/841
6,941,706 B2 * 9/2005 Austin et al. ..... 52/94
6,981,348 B2 * 1/2006 Kjorsvik ..... 52/85
7,051,484 B2 * 5/2006 Nanayakkara ..... 52/481.1
7,424,790 B2 * 9/2008 Austin et al. ..... 52/94
7,571,578 B2 * 8/2009 Moody et al. ..... 52/481.1
7,574,838 B2 * 8/2009 Maisch et al. ..... 52/506.07
7,832,156 B2 * 11/2010 Trotter ..... 52/169.5
7,866,095 B2 * 1/2011 Lin ..... 52/84
8,024,906 B1 * 9/2011 Nelson et al. ..... 52/745.06
2004/0006948 A1 * 1/2004 Nahas ..... 52/749.12
2004/0045252 A1 * 3/2004 Nanayakkara ..... 52/733.2
2004/0134160 A1 * 7/2004 Nanayakkara ..... 52/720.1
2005/0210820 A1 * 9/2005 Tanaka et al. ..... 52/730.6
2006/0000175 A1 1/2006 Neuman
2006/0016130 A1 * 1/2006 Lin ..... 52/24
2006/0075694 A1 * 4/2006 Lin ..... 52/94

* cited by examiner

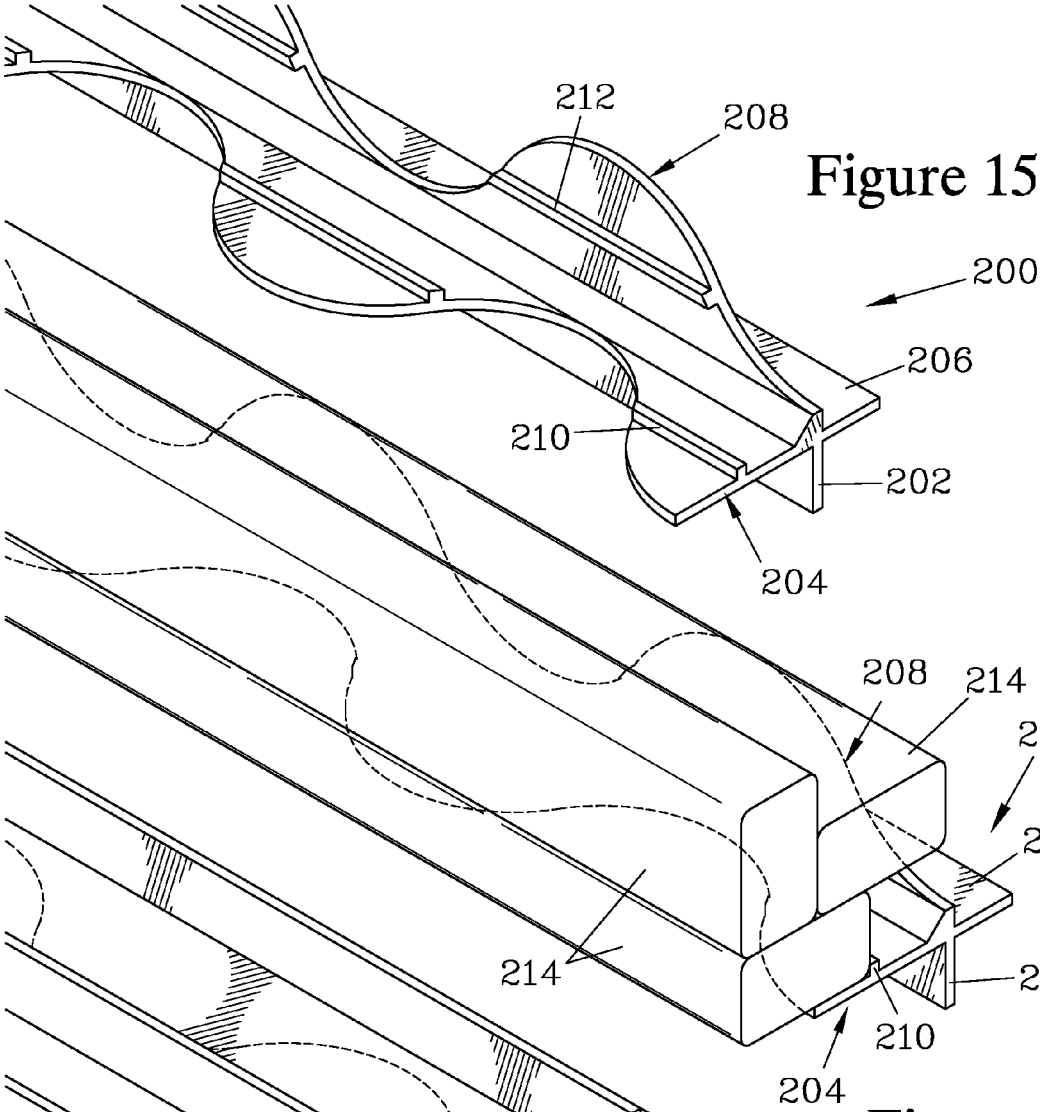
Figure 15
Figure 16
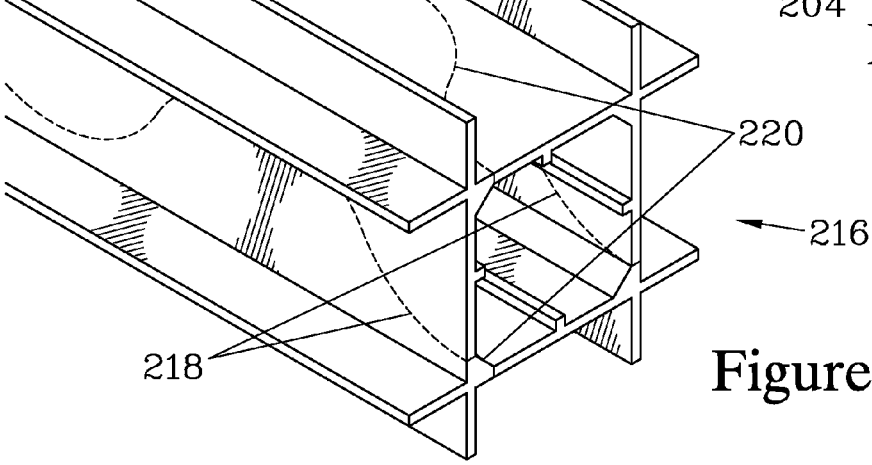
Figure 17

FRAME MEMBER EXTENDER AND METHOD FOR FORMING THE SAME

FIELD OF THE INVENTION

The present invention relates to frame extenders that can be attached to the frame members of a structure to create a wall with increased thickness to allow a greater thickness of insulation to be installed in the wall, and more particularly for a frame extender which reduces heat loss.

BACKGROUND OF THE INVENTION

To conserve energy, it has been found desirable to provide a substantial thickness of insulation in the walls, roofs, and other parts of a structure. While such can be readily achieved by using deeper framing members, such as 2×6 lumber instead of 2×4 lumber for studs, footers, plates, and headers of the frame, this significantly increases the cost of materials. An alternative to the use of 2×6 timbers is to use metal 2×6 members which are typically C-channels that have a web portion with passages therethrough providing openings that result in a constricted cross section and elongated heat transfer path to reduce heat conduction between the terminating surfaces of the member. One such member is taught in U.S. Pat. No. 4,016,700. The use of metal framing may cause additional difficulties in that covering the frame with a surfacing material may require alternative fastening techniques and thus not be fully compatible with standard fabrication techniques used for building stick structures. Also, the use of deeper framing members is not practical when modifying an existing structure to provide increased insulation. A further concern, when larger timbers are used, is that the wooden structural members can provide a thermal bridge between interior and exterior walls, reducing the overall insulating characteristics of the structure. Similar concerns apply for insulating other parts of the structure, such as floors and roofs.

One attempt to overcome these problems is to provide extenders that can fasten to the structural members of the frame to provide increased depth, such as taught in U.S. Pat. No. 4,466,225. The '225 patent teaches an extender formed from sheet metal stamped into a J or C shape, with tabs that serve to align the metal extender against the stud. When so aligned, the extender can be secured to the stud with fasteners such as nails, and provides a mounting surface to which wall surfacing material such as drywall panels can be fastened, this mounting surface being spaced apart from the stud by a certain amount, typically two inches to provide a 2×4 stud with the effective depth of a 2×6 stud. While the '225 extender allows a greater thickness of insulation to be placed in the frame, the use of thermally conductive sheet metal for the extender creates a thermal path that may significantly decrease the benefit of the increased thickness of insulation. This could be particularly true in structures where metal studs are employed.

The embodiment shown in FIG. 1 of the '225 patent has a further deficiency in that it does not provide sufficient passage therethrough to allow ready access through the completed structure for wiring and/or blown-in insulation. While the embodiments shown in FIGS. 2 and 3 of the '225 patent would provide such access, the use of multiple discrete elements complicates construction, since these individual elements must be separately positioned on the stud and fastened thereto. A further complication is that the resulting mounting surface is not continuous, requiring greater care when fastening the wall surface material to the extenders.

SUMMARY OF THE INVENTION

The present invention is for a frame extender for attachment to studs and other framing members that support an inner and outer member such as an inner and outer wall of a structure. These extenders increase the space between an inner wall and an outer wall, thus increasing the thermal insulating capacity of the wall. In addition to heat transfer through the structural members, sound transmission through the structural members of a frame is typically undesirable, as it transmits outside noise to the interior of the structure or transmits noise between adjacent dwelling units in multi-family buildings. Attaching an extender onto the frame members will provide an interface between the frame member and the extender that should help reduce sound transmission through the structure.

The frame extender is formed as an L-shaped body having two orthogonal legs, a short leg and a long leg. The short leg serves as a mounting surface to which a wall surfacing material can be attached. The long leg attaches to the short leg and is employed to fasten to a structural member, and a portion of the long leg forms a mating surface for mating against the structural member. The long leg terminates in an outer edge. Preferably, the outer edge is a serrated edge, so as to provide a toothed profile.

An indexing mark is provided to aid a user in aligning the frame extender against the structural member to which it is to be fastened. The indexing mark is parallel to the short leg and spaced apart therefrom, and substantially traverses the long leg. When the long leg terminates in a serrated edge, the indexing mark traverses the toothed profile of the long leg. Such a configuration reduces the cross section available for thermal bridging when the frame extender is fastened to a structural member, and provides a series of passages to accommodate wiring and/or blown-in insulation.

The indexing mark is preferably provided by a discontinuity in the mating surface of the long leg, such as a ridge, step, or jog, that provides a ledge surface for placement against the structural member to align the frame extender therewith. Preferably, the indexing mark is configured such that the ledge surface projects onto the short leg.

For most applications, it is preferred to employ a jog as the indexing mark, the jog dividing the long leg into a proximal region, which attaches to the short leg and extends between the short leg and the jog, and a distal region, which extends beyond the jog away from the short leg. It is preferred for the jog to be configured such that at least a portion of the distal region of the long leg does not project onto the short leg, since this configuration allows the short leg to better align with the structural member and lets a portion of the long leg bear against the edge of the structural member, providing a compression moment on the portion of the long leg residing between the structural member and the short leg. The use of a jog for the indexing mark may also allow one to reduce the material needed to fabricate the frame extender.

When a ridge or step is employed as the indexing mark, the ridge or step should reside on the side of long leg which the short leg extends beyond. For a step formed by a change in the thickness of the long leg, this provides additional support for the frame extender, since forces against the mounting surface of the short leg will tend to place a compression moment on the thicker portion of the long leg. For either a ridge or a step, this positioning helps assure that the mounting surface of the short leg is substantially aligned with the structural member to which the frame extender is fastened.

When the outer edge is serrated, it is preferred that serrations be provided by a serpentine curve. It is also preferred that the serpentine curve oscillate between the outer extremity of the long leg and the short leg. In one preferred embodiment, the periodicity of the serpentine curve is 8 inches, since this periodicity assures that, when such frame extenders are used to extend plates, headers, or sills, the serpentine curve provides open regions for accommodating studs which are typically set on 16-inch centers, as well as accommodating framing members set on 24-inch centers.

The frame extenders of the present invention are preferably made from a material that has a variety of characteristics including low thermal conductivity, high strength, and ability to accept fasteners. The materials are preferably selected such that they can be readily extruded and/or pressed into shape. One broad class of materials that meet these requirements are composites formed from a particulate material in a binder. Examples of particulate matter that could be effective are particles, fibers, and/or strands of wood or straw. The particulate matter can be mixed with a variety of binders such as a polymer.

To allow the frame extender to be located after a surface finish material such as plasterboard is applied to the extended frame, a magnetically-detectable material can be incorporated into the frame extender. Such could be provided by adding magnetically-detectable particles or by incorporating a strip or wire of magnetically-detectable material into the structure.

While there are a variety of methods by which the frame extender of the present invention can be formed, it is preferred that the frame extender be formed of a composite material as discussed above. When formed from a composite material, the material selected can be extruded or pressed so as to provide a shaped body that either is formed as an L-shaped body, or which can be further processed so as to ultimately form an L-shaped body. If a fibrous material is employed, it may be preferred to press such into a final shape. In some situations where the composite material lacks sufficient flowability, it may be advantageous to steam press the material to increase its formability as it is pressed into shape. Pressing may also be preferable when the frame extenders are to be formed in relatively short lengths. Where the material is very flowable, such as is typically the case for the particulate material when all other parameters are equal, then extrusion is frequently preferred.

In the case where the shaped body is to be subject to further processing to provide an ultimate shape, it is preferred that the subsequent processing step(s) be performed by cutting. It is preferred that the cutting be done by shearing, laser cutting, hot wire cutting, or fluid cutting. The use of laser cutting, hot wire cutting, and fluid cutting have particular benefits when the initial shaped body is formed by extrusion, since the cutting may then be done in-line to provide a continuous process operation.

It is preferred to form the shaped body as either a C-shape or Z-shape, having a base extension and a first end member and a second end member that are normal to the base extension. When such is done, the base extension can be cut to provide a pair of L-shaped bodies, with the cut portions of the base extension forming the long legs and the end members forming the short legs of the resulting frame extenders. Preferably, the cut forms a serpentine path traversing a path between the two end members to provide the long legs of the resulting extenders with toothed profiles.

In the case where the shaped body is Z-shaped, it preferably has a jog on the base extension so as to provide a first extension section attaching to the first end member and a second extension section attaching to the second end member. In this case, it is further preferred that the end members be positioned such that at least a part of a footprint associated with the first extension does not project onto the second end member and, similarly, at least a part of a footprint associated with the second extension does not project onto the first end member.

BRIEF DESCRIPTION OF THE FIGURES

FIG. 2 also shows how the toothed profile of the long leg provides a series of mounting tabs for fastening the long leg to the structural member, as well as a series of passages through the long leg to facilitate installation of wiring and/or blown-in insulation and to reduce the cross section susceptible to thermal bridging across the resulting structure.

FIG. 9 illustrates another advantage of forming the indexing mark as a jog; the use of a jog in the frame extender fastened to a bottom plate of the frame positions the short leg of the frame extender so as to avoid interference with similar frame extenders used to extend studs which are attached to the bottom plate. Such a frame extender will also avoid interference when used to extend a top plate.

FIG. 15 shows an alternative frame extender which is designed for use in corners. The frame extender of this embodiment has a secondary short leg which joins to the short leg and is positioned at a right angle thereto, and has a secondary long leg which extends at a right angle to the long leg.

FIG. 16 shows the corner extender shown in FIG. 15 placed against a combination of structural members forming a corner of a structural frame.

FIG. 17 shows a box-shaped body which can be cut to form four corner extenders such as the one shown in FIGS. 15 and 16.

DETAILED DESCRIPTION OF THE PREFERRED EMBODIMENTS

Figures 1, 2:
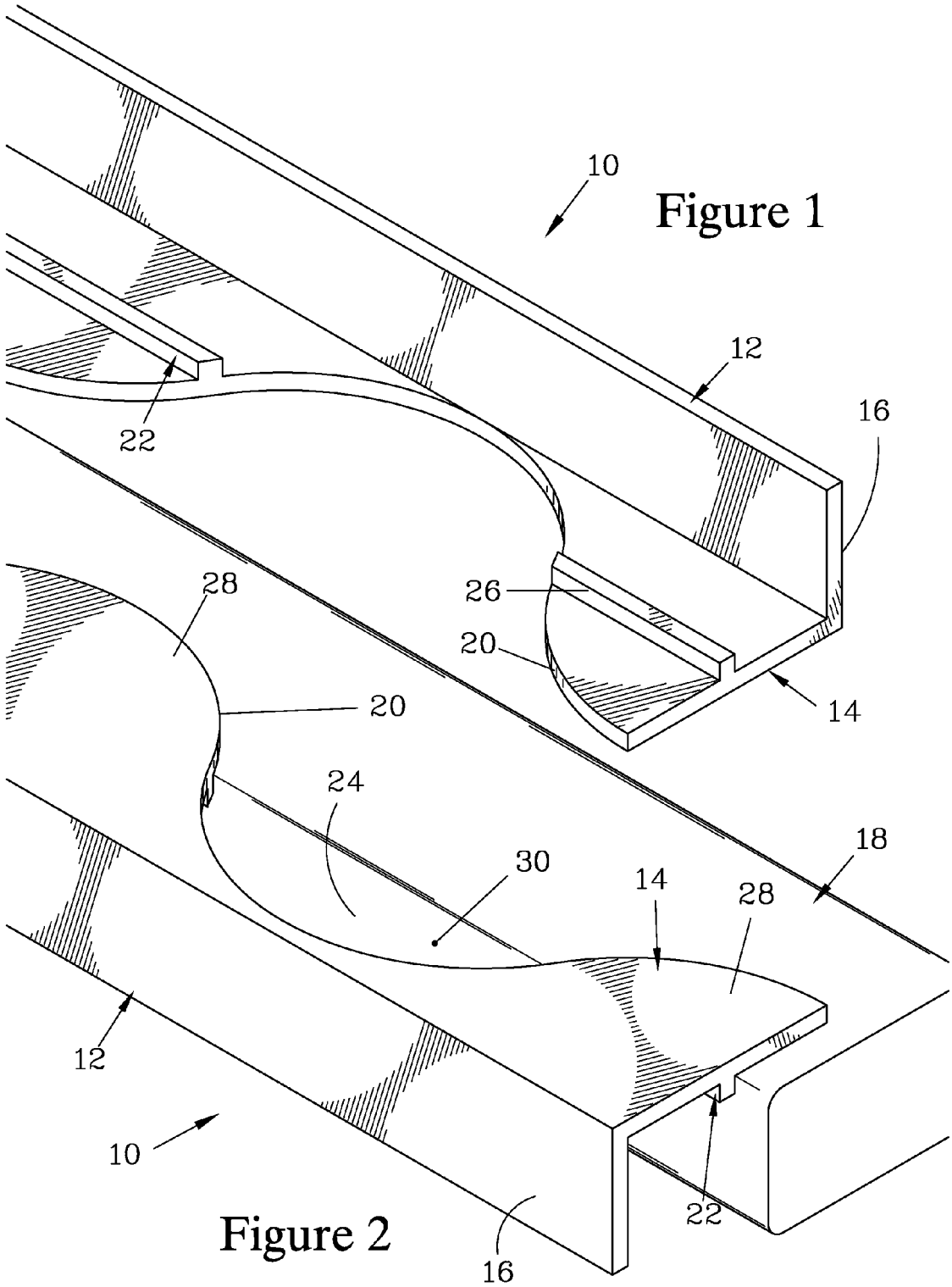
FIG. 1 is an isometric view illustrating one embodiment of the present invention, a frame extender having an L-shaped cross section formed by a short leg, to which a wall surfacing material can be mounted, and a long leg which attaches to a structural member and has a toothed profile formed by a serpentine serrated edge. The long leg also has a ridge extending parallel to and spaced apart from the short leg, which serves as an indexing mark.
FIG. 2 is an isometric view of the frame extender shown in FIG. 1, showing the ridge engaged against the edge of a structural member, ready for the long leg to be fastened thereto. When a ledge surface of the ridge engages the structural member, it aligns the frame extender such that the short leg is parallel to the structural member, with a mounting surface of the short leg spaced a desired distance from the edge of the structural member.

FIG. 1 illustrates a frame extender 10 that can be fastened to studs and other structural members to increase their effective depth, thereby providing space for additional insulation and decreasing the size of the thermal bridge, and which may serve to reduce sound transmission through the resulting structure. The frame extender 10 also provides open passages in the extended frame to facilitate installation of wiring and/or blown-in insulation.

The frame extender 10 is formed as an L-shaped body having a short leg 12 and a long leg 14 positioned substantially normal to each other. The short leg 12 provides a mounting surface 16 to which a surface material (not shown) can be attached with conventional fasteners, such as drywall screws. The long leg 14 serves to attach to a structural member 18 (shown in FIGS. 2 and 3), and terminates in a serrated edge 20, so as to provide a toothed profile. In the embodiment shown in FIGS. 2 and 3, the toothed profile is defined by a serpentine curve.

An indexing mark 22 is provided on the long leg 14, extending parallel to the short leg 12 and spaced apart therefrom, traversing the toothed profile of the serrated edge 20. The spacing of the indexing mark 22 from the short leg 12 is such that, when the indexing mark 22 is aligned with an edge 24 of the structural member 18, the mounting surface 16 on the short leg 12 is positioned a desired distance from the edge 24. In a typical application, this distance is two inches, so as to provide a 2×4 structural member with a combined depth equal to that of a 2×6 structural member. Greater depths could be used to further increase the thermal properties of the resulting structure. The indexing mark 22 of this embodiment is formed as a ridge positioned on the same side of the long leg 14 as the short leg 12, thereby providing a ledge surface 26 that faces away from the short leg 12 and can be readily placed against the edge 24 of the structural member 18. The ledge surface 26 preferably projects onto the short leg 12 in order to substantially align the short leg 12 with the structural member 18.

Figure 3:
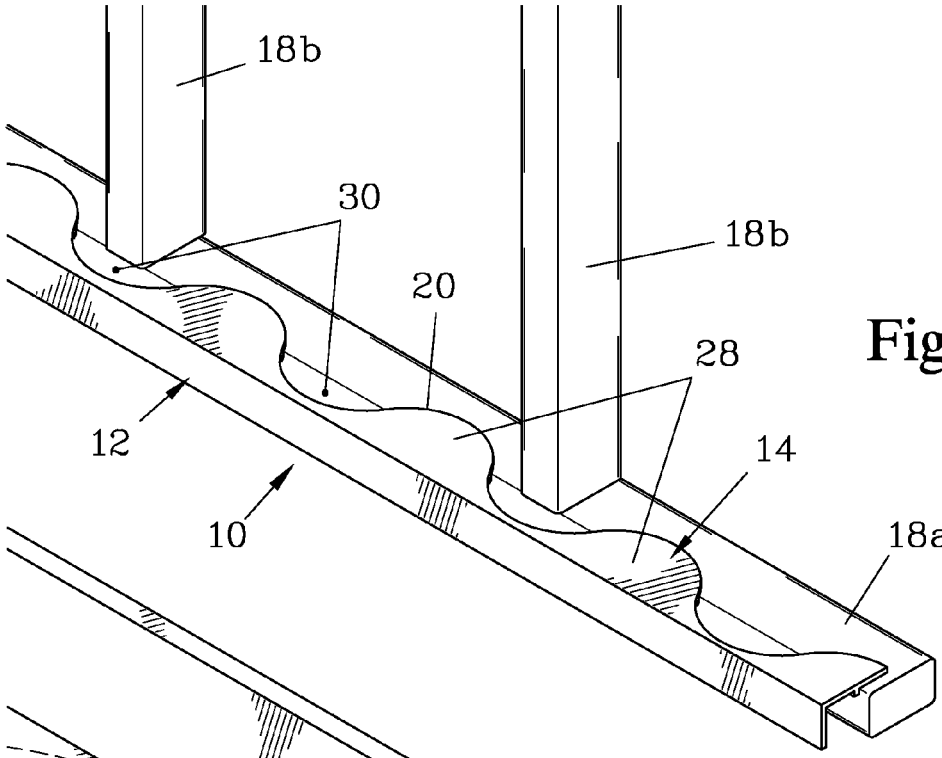
FIG. 3 is an isometric view that illustrates the frame extender shown in FIGS. 1 and 2 fastened to a bottom plate of a frame. The toothed profile of the frame extender attached to the bottom plate has a period selected to accommodate studs attached to the bottom plate at specified intervals.

The toothed profile of the long leg 14 provides a series of mounting tabs 28 that can be fastened to the structural member 18 with conventional fasteners, such as nails or screws (not shown). Because the indexing mark 22 traverses the serrated edge 20, the toothed profile of the serrated edge 20 provides a series of passages 30 through the long leg 14 when the frame extender 10 is fastened to the structural member 18 with the indexing mark 22 aligned with the edge 24 of the structural member 18, as shown in FIGS. 2 and 3. These passages 30 provide access for installation of wiring and/or blown-in insulation. The toothed profile also reduces the cross section available for forming a thermal bridge across insulation which is subsequently added.

Figure 4:
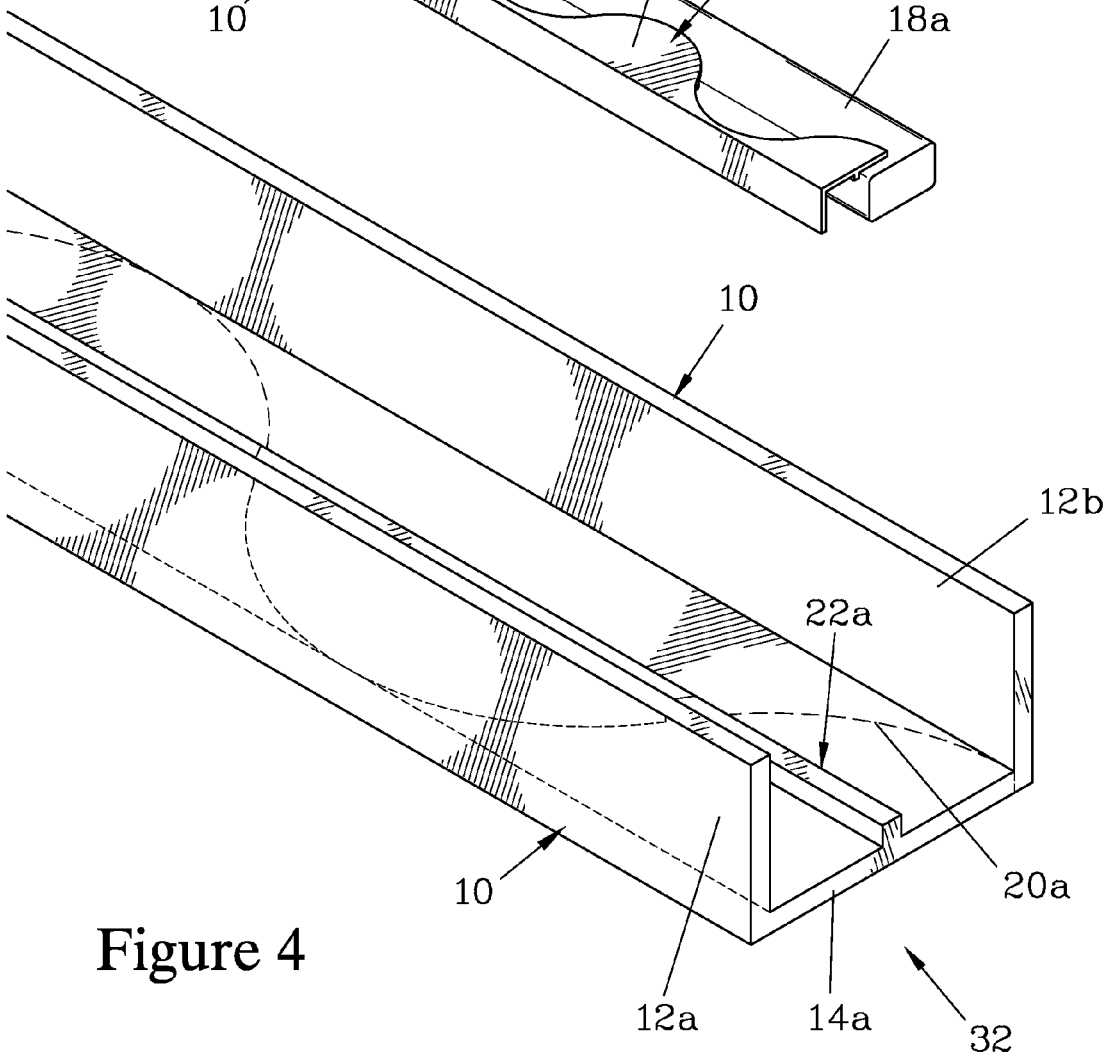
FIG. 4 is an isometric view that illustrates a C-shaped body that can be cut along a serpentine path to form two L-shaped bodies, each of which forms a frame extender such as the frame extender shown in FIGS. 1-3. The C-shaped body has a base extension having a first end member and a second end member attached thereto, and a ridge extending parallel to and between the first and second end members. When the shaped body is cut, each of the end members forms the short leg of one of the frame extenders, while the base extension forms the long leg. The serpentine path of the cut provides a toothed profile to each of the long legs.

The frame extender 10 is preferably formed of a relatively non-conductive material to further reduce thermal conduction across the insulation. Examples of materials which are felt to be effective are plastics and fibrous or particulate filler materials with a plastic or other binder. The material should also be selected to readily accept fasteners, and the short leg 12 should have a sufficient thickness to allow wall surfacing material to be attached thereto by conventional fasteners, such as drywall screws. For a fiber particle-filled plastic material, it is preferred for the short leg 12 to have a thickness of about ⅜", while a thickness of ⅛"-¼" is preferably used for the long leg 14. As shown in FIG. 4, the frame extender 10 can be fabricated from a C-shaped body 32 that is cut into two pieces, each forming a frame extender 10, as discussed in greater detail below.

Preferably, the toothed profile of the serrated edge 20 has a period or wavelength of about eight inches. This results in the passages 30 being spaced eight inches apart, allowing the frame extender 10 to be attached to a top plate, bottom plate, or header such as a bottom plate 18*a*, as shown in FIG. 3, while accommodating studs 18*b* that are attached to the bottom plate 18*a* at either sixteen inch or twenty-four inch center-to-center spacing.

Frame extenders such as the frame extender 10 discussed above can be fabricated individually in a single operation by injection molding, pressing or stamping. However, it is typically preferred for the frame extender 10 to be formed with a multi-step operation in which a blank such as the C-shaped body 32 is first formed, and then is cut to form two frame extenders 10, as shown in FIG. 4. The C-shaped body 32 is configured with a base extension 14*a* having a first end member 12*a* and a second end member 12*b* attached thereto. The base extension 14*a* is substantially longer than the two end members (12*a*, 12*b*). The base extension 14*a* will form the long legs 14 of the frame extenders 10, while the first end member 12*a* and the second end member 12*b* will each provide one of the short legs 12. After the C-shaped body 32 is formed, its base extension 14*a* is cut along a serpentine path 20*a* so as to provide two L-shaped bodies, each having a long leg 14 that is serrated to provide a toothed profile.

When the C-shaped body 32 is extruded, an indexing mark 22*a* is provided as part of the extrusion and the serpentine cut traverses the indexing mark 22*a* as it traverses across the base extension 14*a* to form the toothed profiles. In this case, the indexing mark 22*a* is centered in the C-shaped body 32.

When the blank is formed with a continuous process such as extrusion, it is advantageous to be able to provide in line cutting and this can readily be done by laser cutting, hot wire cutting and other techniques appropriate for composition of the extruded blank.

Figure 5:
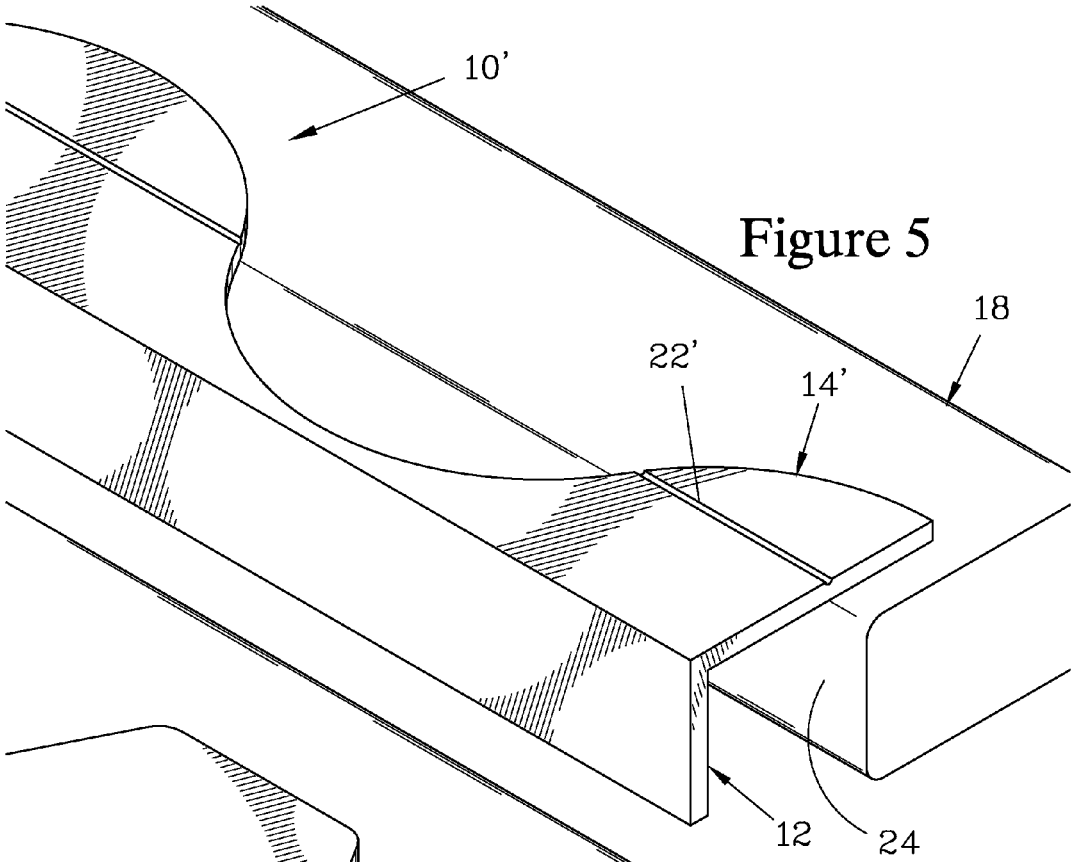
FIG. 5 is an isometric view of a frame extender which forms another embodiment of the present invention. The frame extender differs from the frame extender shown in FIGS. 1-3 in that it has an indexing mark formed as a groove which a user can visually align with the edge of a structural member to which the frame extender is to be fastened.

FIG. 5 shows an alternative embodiment, a frame extender 10' where the indexing mark 22' on the long leg 14' is provided by a groove. When the indexing mark 22' is formed as a groove, it is preferred for the indexing mark 22' to be positioned on the opposite side of the long leg 14' than that from which the short leg 12 extends, so that the indexing mark 22' is readily visible when the frame extender 10' is positioned with the long leg 14' against a structural member 18 with the short leg 12 superimposed over an edge 24 of the structural member 18. It should be appreciated that alternative indexing marks could be employed, such as painted or printed markings, a linear series of dots or tabs, or a jog in the long leg such as discussed below with regard to FIGS. 7-14.

Figure 6:
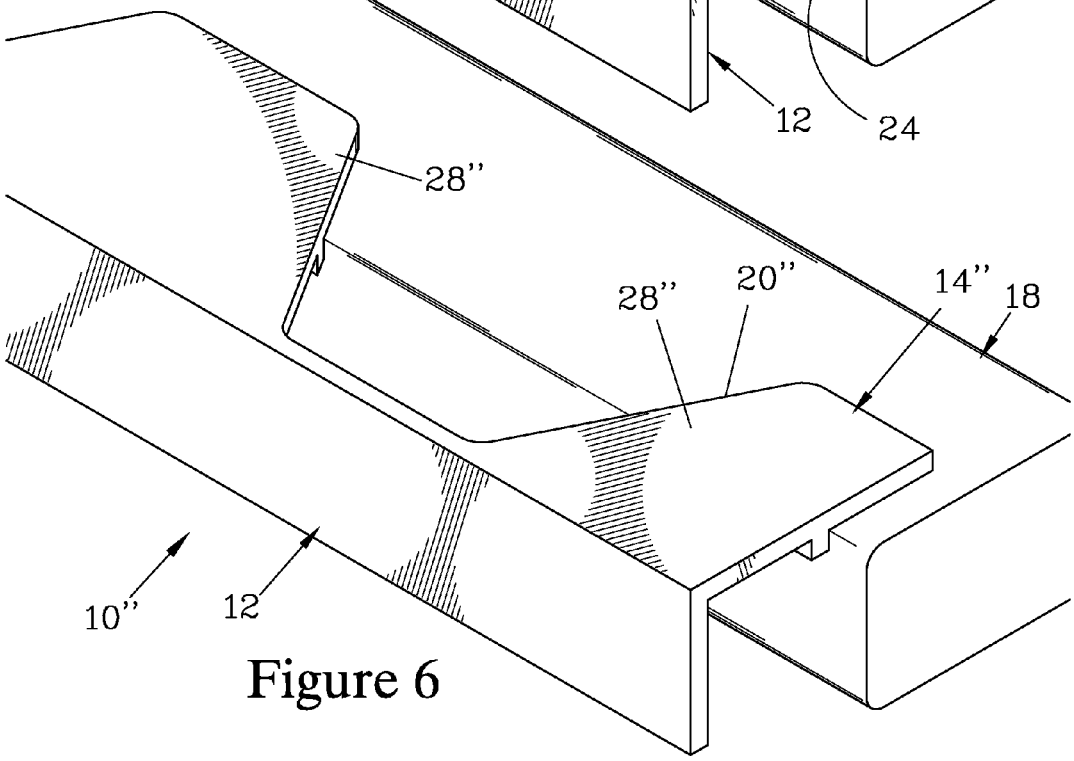
FIG. 6 is an isometric view of a frame extender which forms another embodiment of the present invention. This frame extender differs from the frame extender shown in FIGS. 1-3 in that the toothed profile of the long leg provides mounting tabs that are substantially trapezoidal in shape.

FIG. 6 shows another alternative embodiment, a frame extender 10" where the long leg 14" has a different serrated edge 20". In this embodiment, the serrated edge 20" is configured to provide a series of mounting tabs 28" that are substantially trapezoidal. These mounting tabs 28" have rounded corners to avoid sharp inside corners that might cause stress points when the frame extender 10" is fastened to a structural member 18 and supports a wall surface panel (not shown) fastened to the short leg 12. It should be appreciated that alternative toothed profiles could be employed; however, when the frame extenders are formed by cutting apart a shaped body as discussed above, a serpentine path is preferred for the toothed profile to minimize the linear footage of the cut and to facilitate the cutting process.

Figure 7:
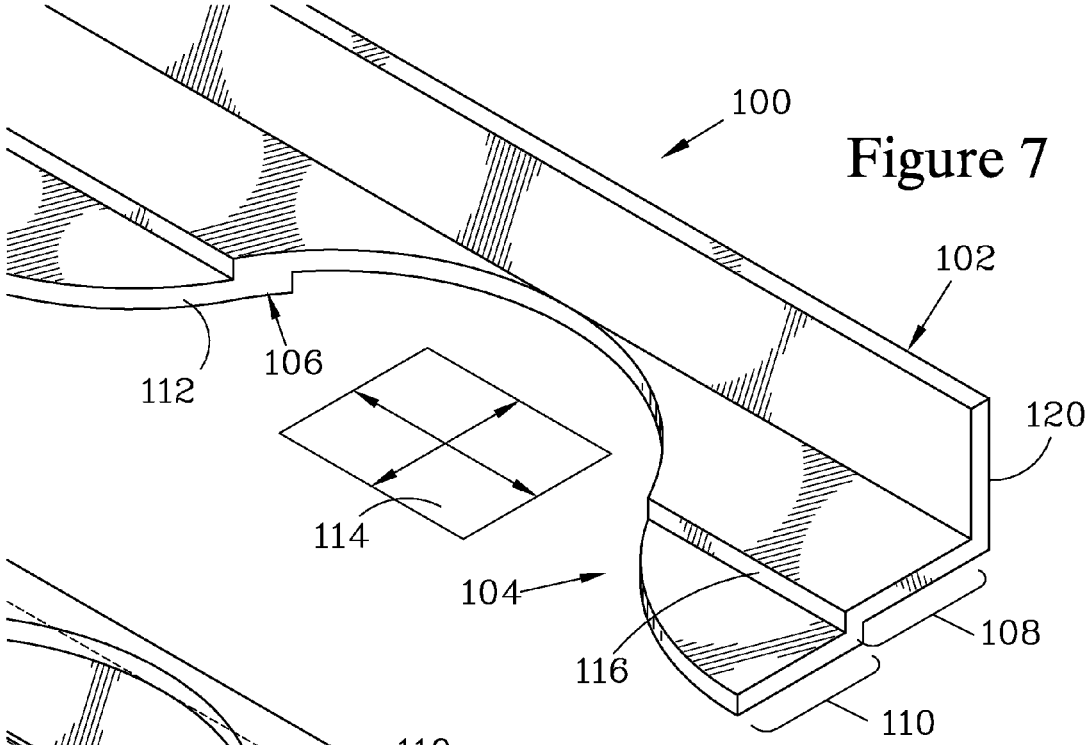
FIG. 7 is an isometric view illustrating another embodiment of the present invention, a frame extender which employs a jog in the long leg as an indexing mark. The jog allows the long leg to be positioned to bear directly against a structural member. When so positioned, the short leg is aligned with the structural member so that it projects onto the structural member.

FIG. 7 is an isometric view illustrating another embodiment of the present invention, a frame extender 100 formed as a generally L-shaped body having a short leg 102 and a long leg 104. The frame extender 100 has a jog 106 in the long leg 104 which serves as an indexing mark, the jog 106 extending parallel to the short leg 102 and being spaced apart therefrom. The jog 106 partitions the long leg 104 into a proximal region 108, which attaches to the short leg 102, and a distal region 110, which is spaced apart from the short leg 102. The long leg 104 terminates in a serrated edge 112, which traverses the jog 106.

In this embodiment, the jog 106 is formed such that the proximal region 108, when projected parallel to a reference plane 114, does not project onto the distal region 110. Similarly, when the distal region 110 is projected parallel to the reference plane 114, it does not project onto the proximal region 108. Alternatively stated, the jog 106 is configured such that the distal region 110 does not project onto the short leg 102.

Figure 8:
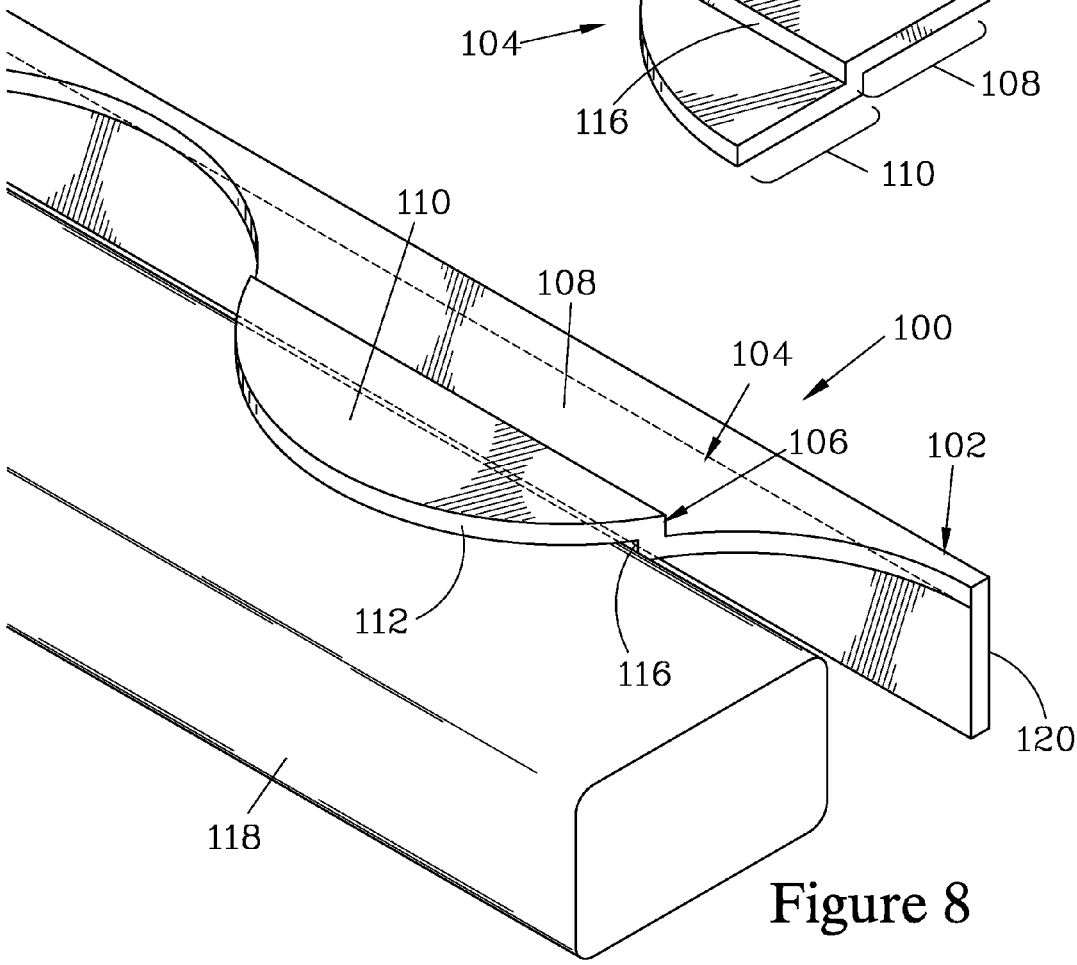
FIG. 8 is an isometric view of the frame extender shown in FIG. 7 when placed against a structural member.
Figure 9:
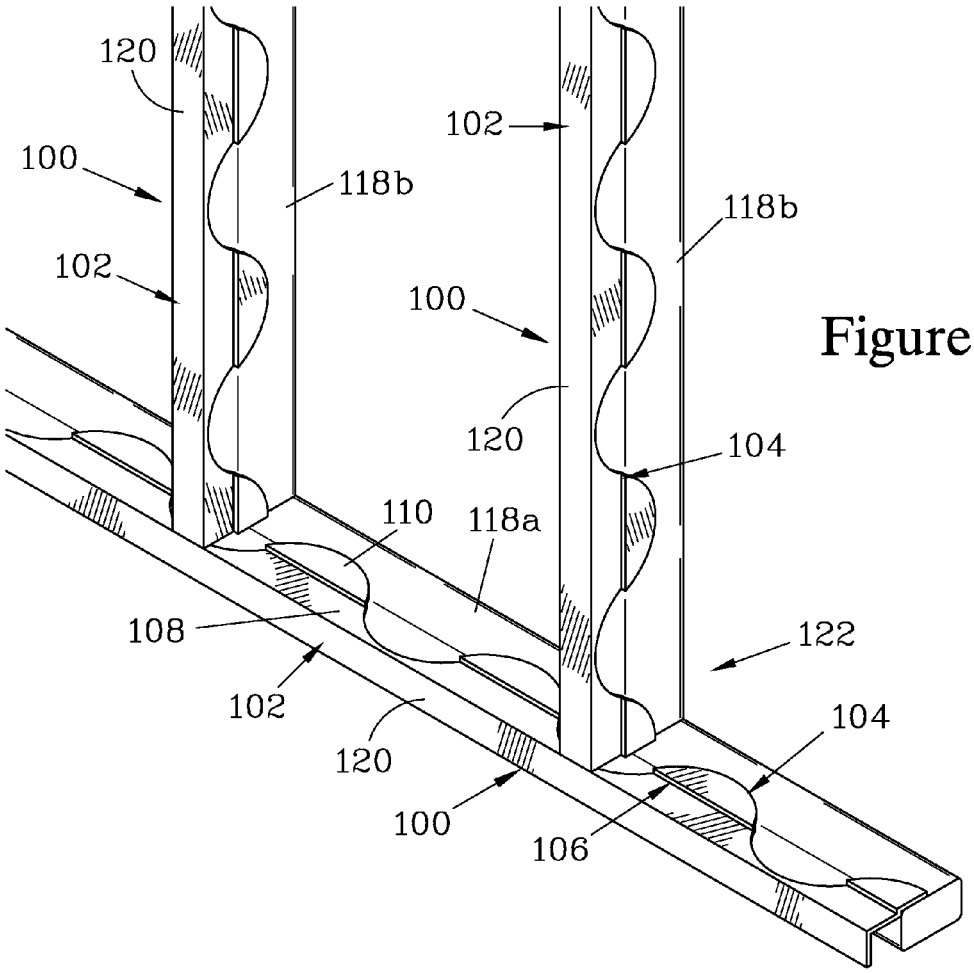
FIG. 9 is an isometric view showing a portion of a frame that has been extended by adding a number of frame extenders such as the frame extender shown in FIGS. 7 and 8.

The jog 106 provides a ledge surface 116 that can be placed against a structural member 118, as shown in FIGS. 8 and 9. The ledge surface 116 projects onto the short leg 102 such that, when the ledge surface 116 is placed against the structural member 118, the short leg 102 is aligned with the structural member 118. The proximal region 108 of the long leg 104 can bear directly against the structural member 118 to better accommodate any forces against a mounting surface 120 (best shown in FIG. 9) of the short leg 102, since such forces will tend to place a compressive moment on the proximal region 108.

FIG. 9 shows a portion of a frame 122 that has been extended by adding a number of frame extenders 100 to a bottom plate 118*a* and two studs 118*b*, to illustrate another advantage of employing the jog 106 to provide an indexing mark. As pointed out above, the jog 106 is preferably formed such that the short leg 102 is aligned with the structural member 118 when the ledge surface 116 formed by the jog 106 is placed against the structural member 118, and the distal region 110 of the long leg 104 does not project onto either the proximal region 108 or the short leg 102. As shown in FIG. 9, this configuration places the proximal region 108 and the short leg 102 of the frame extender 100 that is fastened to the bottom plate 118*a* in such a position as to avoid interference with the frame extenders 100 that are fastened to the studs 118*b*.

Figure 10:
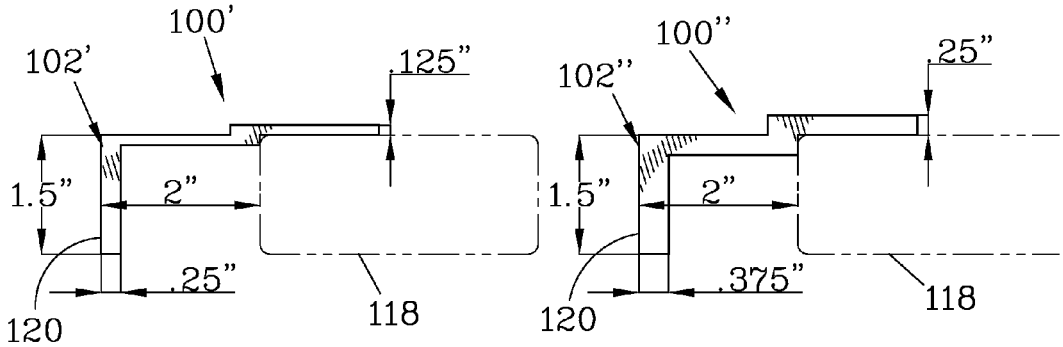
FIG. 10 shows end views of frame extenders illustrating preferred dimensions for the frame extenders shown in FIGS. 7-9 when designed for use with structural members formed from conventional 2×4 lumber.

FIG. 10 shows end views of a frame extender 100' and a frame extender 100", showing preferred dimensions for these frame extenders (100', 100") when designed for use with structural members 118 (shown in phantom) formed from conventional 2×4 lumber. These dimensions result in the mounting surface 120 of the short leg (102', 102") being spaced two inches from the structural member 118, thereby providing the combination of the structural member 118 and the frame extender (100', 100") the same depth as would be provided if the structural member 118 were formed from 2×6 lumber.

Figures 11, 12:
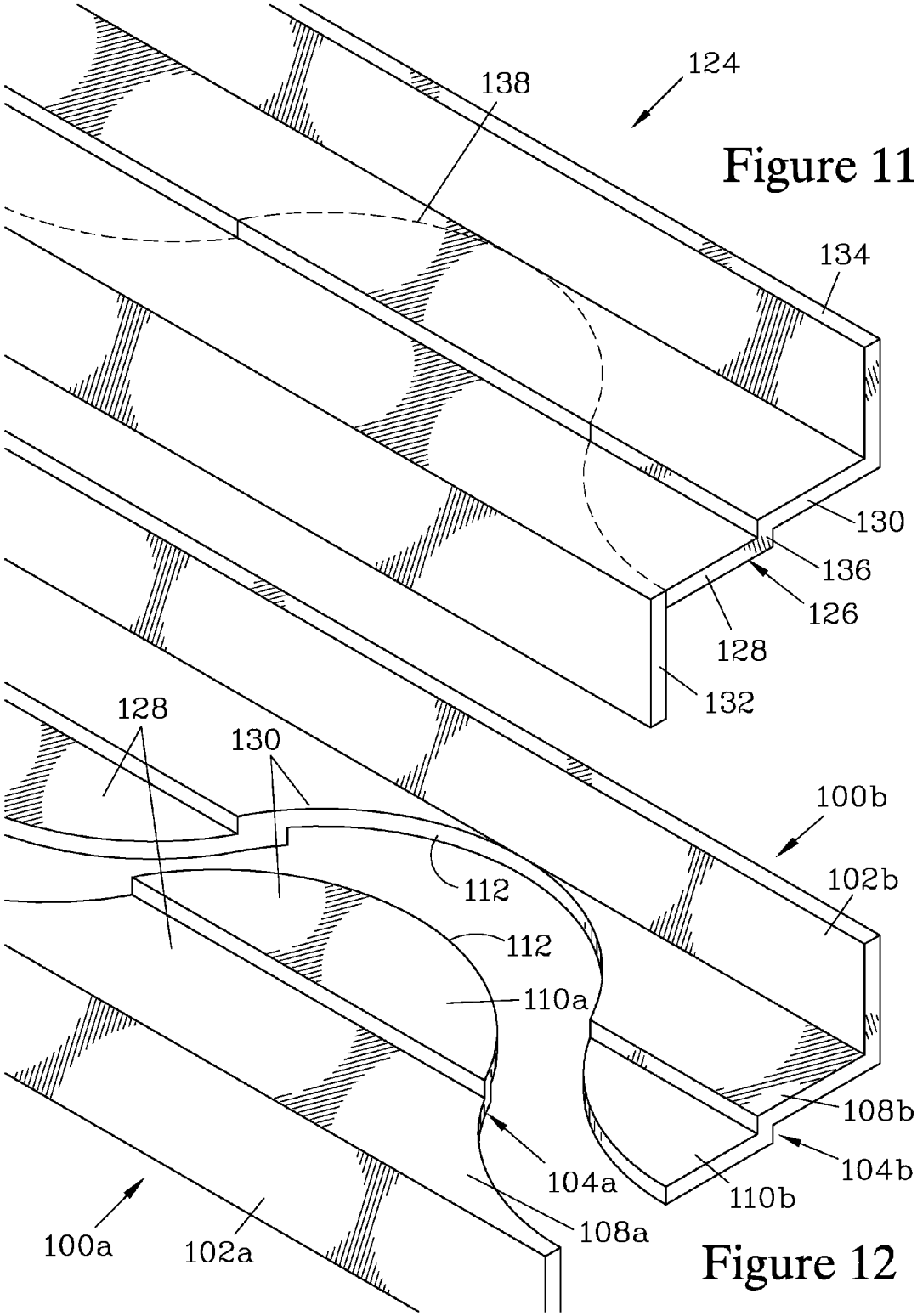
FIG. 11 is an isometric view of a Z-shaped body that is formed in a preferred method of fabricating frame extenders such as those shown in FIGS. 7-10. The Z-shaped body can be formed as an extrusion. The Z-shaped body is cut along a serpentine path (indicated with a dashed line) to form two frame extenders with L-shaped bodies.
FIG. 12 shows the two frame extenders formed from the Z-shaped body shown in FIG. 11.

As with the frame extender 10 discussed above, there are a variety of techniques to fabricate the jog-containing frame extender 100. When the frame extender 100 is to be formed in a two-stage process, where a shaped body 124 having a Z-shaped cross section is first formed and then is cut along a serpentine path to form two L-shaped frame extenders 100, the following method of fabrication can be readily employed. FIG. 11 shows the Z-shaped body 124, which has a base extension 126 having a base first extension section 128 and a base second extension section 130, to which a first end member 132 and a second end member 134 are respectively attached. The base extension 126 has a jog 136 positioned between the end members (132, 134) such that the base extension sections (128, 130) do not project onto each other and the base first extension section 128 does not project onto the second end member 134, and similarly the base second extension section 130 does not project onto the first end member 132.

The Z-shaped body 124 can be formed by the methods discussed above for forming the C-shaped body 32, or could be formed by affixing two L-shaped forms together with a lap joint, the lap joint forming the jog 136 in the base extension 126.

The base extension 126 of the Z-shaped body 124 is cut along a serpentine path 138 to form two frame extenders (100*a*, 100*b*), as shown in FIG. 12. When cut apart, each of the pieces of the base extension 126 forms the long leg (104*a*, 104*b*) of one of the frame extenders (100*a*, 100*b*), while each of the first and second end members (132, 134) forms one of the short legs (102*a*, 102*b*). For the frame extender 100*a*, the portion of the base first extension section 128 that attaches to the short leg 102*a* (formed by first end member 132) forms the proximal region 108*a* of the long leg 104*a*, while the portion of the base second extension section 130 attached thereto forms the distal region 110*a*. Similarly, for the frame extender 110*b*, the portion of the base second extension section 130 that attaches to the short leg 102*b* (formed by the second end member 134) forms the proximal region 108*b* of the long leg 104*b*, while the portion of the base first extension section 128 attached thereto forms the distal region 110*b*. The serpentine path 138 of the cut defines the serrated edges 112 of the frame extenders (100*a*, 100*b*).

Figure 13:
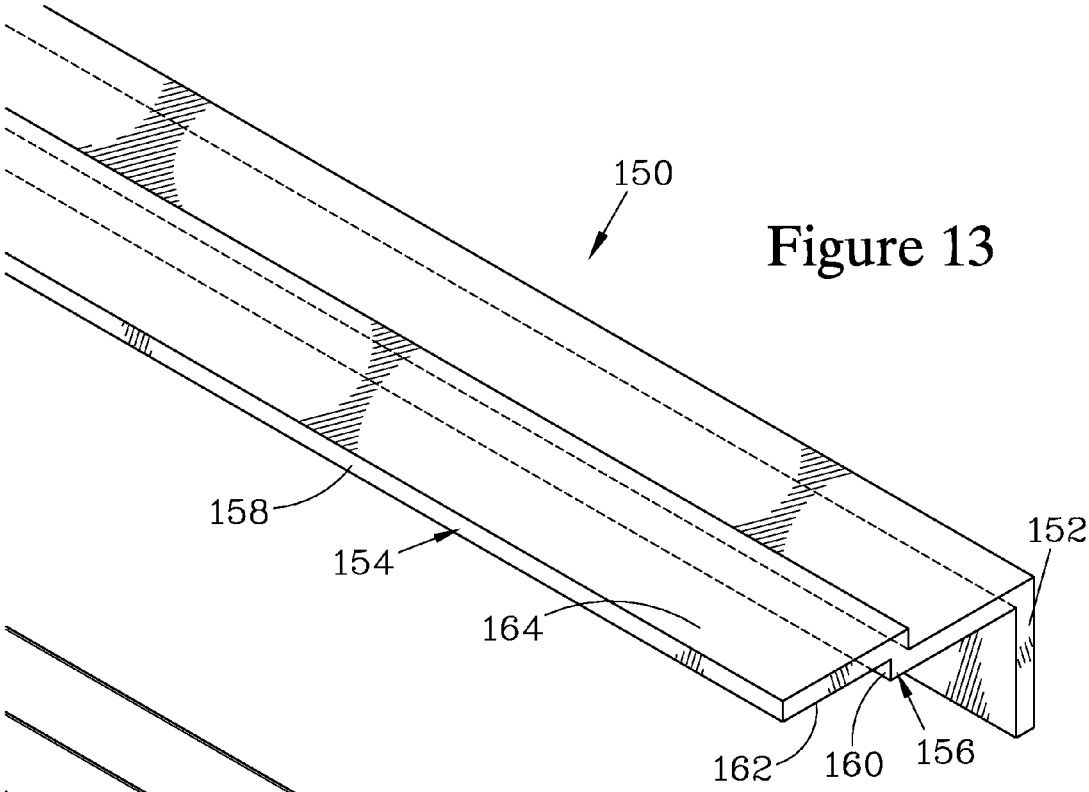
FIG. 13 is an isometric view showing a frame extender which employs a jog on the long leg, as does the frame extender shown in FIGS. 7-11, but which does not have a serrated edge.

FIG. 13 is an isometric view showing another embodiment of the present invention, a frame extender 150 formed as a generally L-shaped body having a short leg 152 and a long leg 154 and having a jog 156 in the long leg 154 which serves as an indexing mark. However, in the frame extender 150, the long leg 154 terminates at a straight outer edge 158 that is parallel to the jog 156 and the short leg 152. The frame extender 150 does not provide all of the benefits that would be present for the embodiments discussed above, since the structure resulting from attaching the frame extender 150 to a structural member would lack passages resulting from a serrated edge. However, the use of the jog 156 does maintain a more supportive extension when mounted to a structural member than is provided by frame extenders where the long leg is straight, such as those shown in FIGS. 1-6.

The jog 156 provides a ledge surface 160 that can be placed against a structural member when a mating surface 162 of the long leg 154 is placed against the structural member. When the frame extender 150 is positioned with the ledge surface 160 and the mating surface 162 against the structural member, the short leg 152 is substantially aligned with and superimposed onto the structural member.

Figure 14:
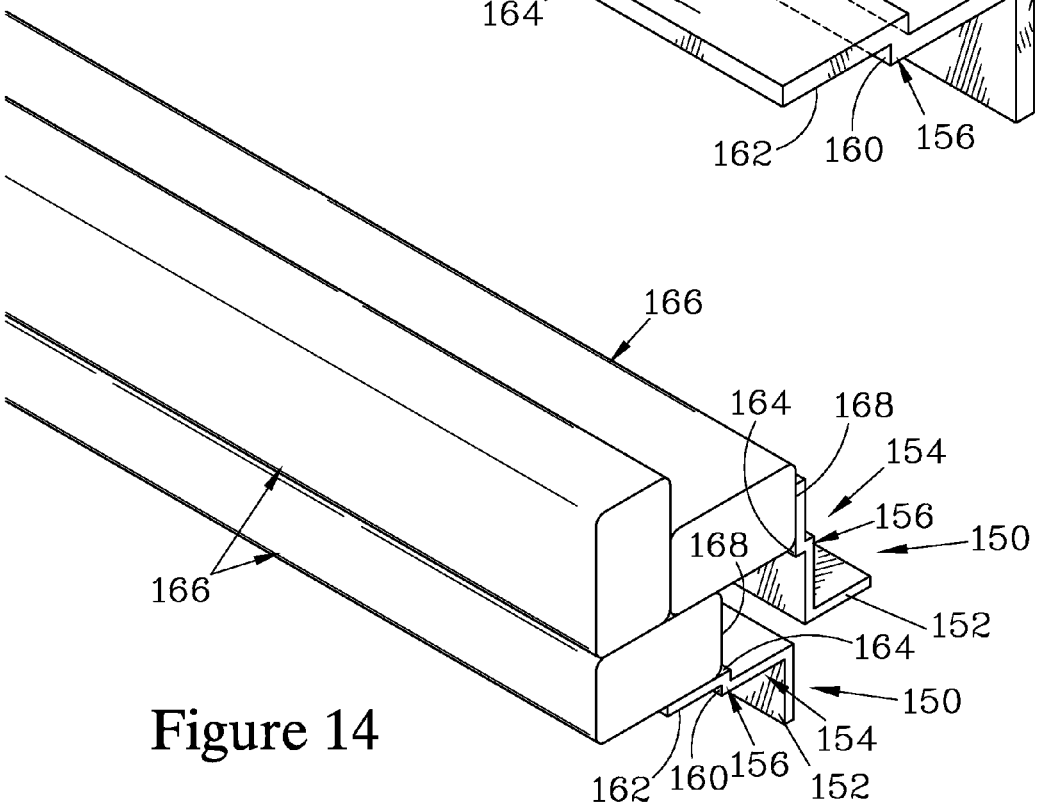
FIG. 14 is an isometric view showing two of the frame extenders such as the ones shown in FIGS. 7-12 and FIG. 13, placed against structural members that form a corner of a frame. For this application, the frame extenders are placed such that the short leg does not project onto the structural member to which the long leg of the frame extender is fastened. The jog offsets each of the short legs such that they do not interfere with each other when attached to the corner structural members.

The long leg 154 of this embodiment, as well as the long leg in the earlier embodiments, also has a secondary surface 164 which is opposite the mating surface 162. As shown in FIG. 14, the long leg 154 can be placed against a structural member 166 with the secondary surface 164 instead of the mating surface 162 against the structural member 166. In this orientation, the ledge surface 160 provides a visual indexing mark that can be aligned with an edge 168 of the structural member 166 or other structural members such as a bottom plate and top plate to aid a user in properly aligning the frame extender 150 with respect to the structural member 166. This alignment can be most conveniently done when the frame extender has a long leg with a serrated edge, such as is illustrated in FIGS. 7-10. When the frame extender 150 is fastened to the structural member 166 in this position, the jog 156 offsets the short leg 152 relative to the structural member 166. This offset can reduce interference between the short legs 152 of two frame extenders 150 that are attached to structural members 166 forming a corner, when the frame extenders 150 are each fastened to their respective structural member 166 with their secondary surface 164 against the structural member 166.

It should be noted that when the frame extenders 100 shown in FIGS. 7-10 are attached to structural members in a corner in the manner described above, they provide the additional benefits of reducing thermal bridging and providing passages to allow wiring and/or insulation to be installed around the corner.

For embodiments which do not employ a jog to provide the indexing mark, corners can be formed by employing commercially available drywall corner clips which are fastened to the mounting surface of the short leg of the extender, while the long leg is fastened to a structural member forming a part of the corner.

FIG. 15 shows a corner extender 200 which is specifically designed for use in corners, having an X-shaped body. The X-shaped body of this embodiment again has a short leg 202 and a long leg 204, but additionally has a secondary short leg 206, which joins to the short leg 202 and is positioned at a right angle thereto, and a secondary long leg 208, which extends at a right angle to the long leg 204. The long leg 204 has a primary indexing mark 210 thereon, and the secondary long leg 208 has a secondary indexing mark 212. As shown, both indexing marks (210, 212) are formed as ridges. These indexing marks (210, 212) can be placed against structural members 214 that form a corner of a structure to align the corner extender 200 with the structural members 214, as shown in FIG. 16. The long leg 204 and the secondary long leg 208 are then fastened to the structural members 214 against which they are placed, and the short leg 202 and the secondary short leg 206 provide a corner spaced apart from the structural members 214, to which a wall surface material can be attached.

The corner extender 200 can be formed from an extruded shaped body 216, shown in FIG. 17. The shaped body 216 can be cut along two serpentine paths (218 and 220) so as to provide four corner extenders 200.

Figure 19:
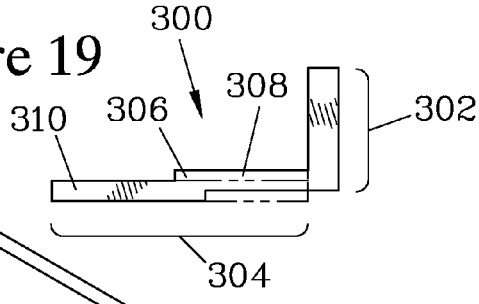
FIGS. 19 and 20 illustrate alternate options for defining the geometry of the frame extender shown in FIG. 18.
Figure 18:
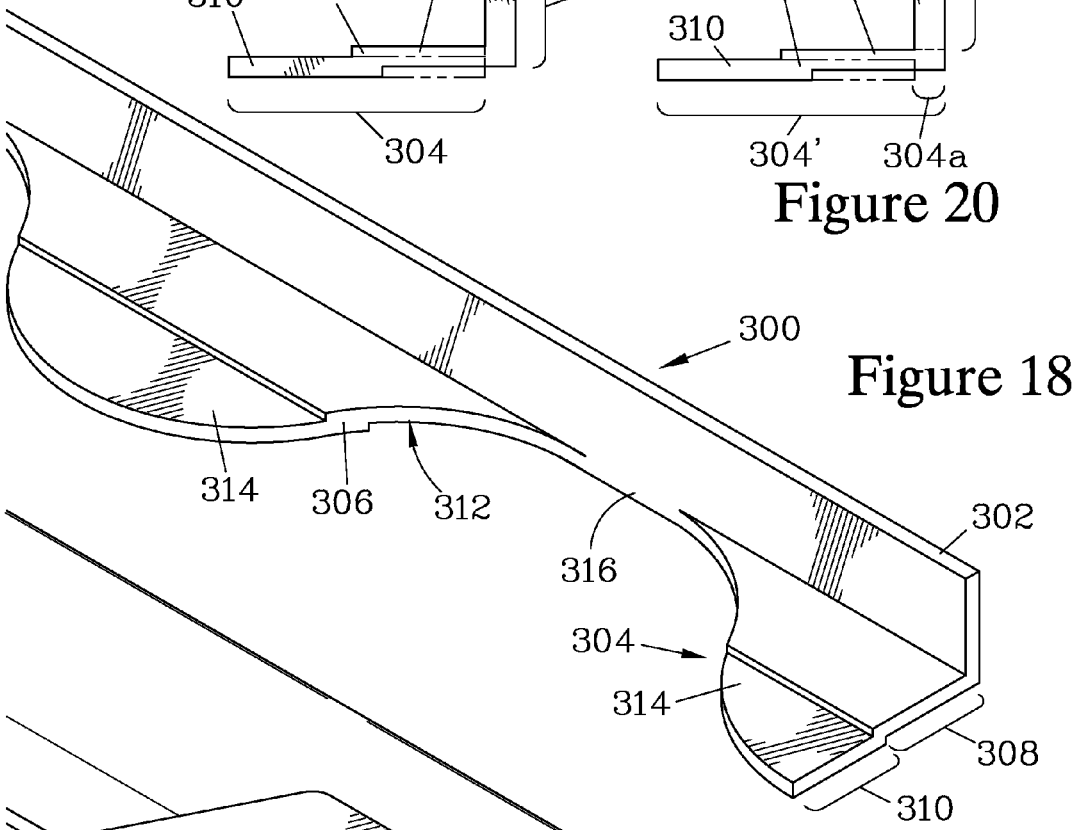
FIG. 18 is an isometric view of another embodiment of the present invention, a frame extender which employs a jog in the long leg as an indexing mark. This embodiment differs from that shown in FIGS. 7-10 in that the jog does not fully offset a distal region of the long leg, so that a portion of the distal region does project onto the short leg. This embodiment also differs in its serrated edge, which has a serpentine path configured to increase the spacing between the resulting mounting tabs formed by the long leg.

FIG. 18 is an isometric view illustrating a frame extender 300, the cross section of which is shown in FIG. 19. Like the frame extender 100 discussed above, the frame extender 300 has a generally L-shaped body with a short leg 302, a long leg 304, and a jog 306 in the long leg 304 that provides an indexing mark. The jog 306 again partitions the long leg 304 into a proximal region 308 and a distal region 310. However, in this embodiment, the jog 306 is configured such that the proximal region 308 and the distal region 310 project partially onto each other, as best shown in FIG. 19. This results in a portion of the distal region 310 projecting onto the short leg 302, while another portion of the distal region 310 does not project onto the short leg 302.

Figure 20:
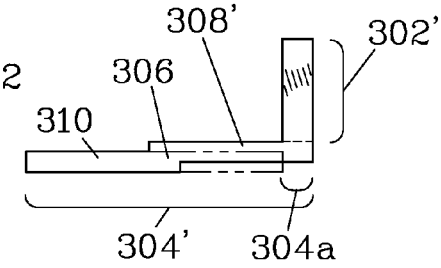

In the above descriptions of the embodiments, the short leg has been assumed to extend fully across the L-shaped body, with the long leg attached thereto, as illustrated in FIG. 19. The terminology used to describe the frame extender 300 shown in FIGS. 18 and 19 could alternatively be described in terms of FIGS. 18 and 20, in which the generally L-shaped body is described as having a long leg 304' with a short leg 302' attached thereto so as to abut a terminal region 304*a* of the long leg 304' and extending normal to the long leg 304'. The jog 306 is configured to partition the long leg 304' into a proximal region 308', to which the short leg 302' attaches, and the distal region 310, which is spaced apart from the short leg 302'. Using this definition of the structure, neither the proximal region 308' nor the distal region 310 projects onto the short leg 302'. Thus, for the purposed of describing the invention, the definitions of the elements will be as shown in FIG. 19.

The frame extender 300 also differs in the configuration of a serrated edge 312, which traverses the jog 306 and terminates the long leg 304, forming a series of mounting tabs 314. In this embodiment, the serrated edge 312 has a series of straight segments 316 (only one of which is shown in FIG. 18) between the mounting tabs 314, these straight segments 316 serving to space the mounting tabs 314 more widely apart compared to the serrated edge 112 of the frame extender 100. The increased spacing of the mounting tabs 314 reduces the overall cross section of the long leg 304 that is available to form a thermal bridge across the frame extender 300.

Figure 21:
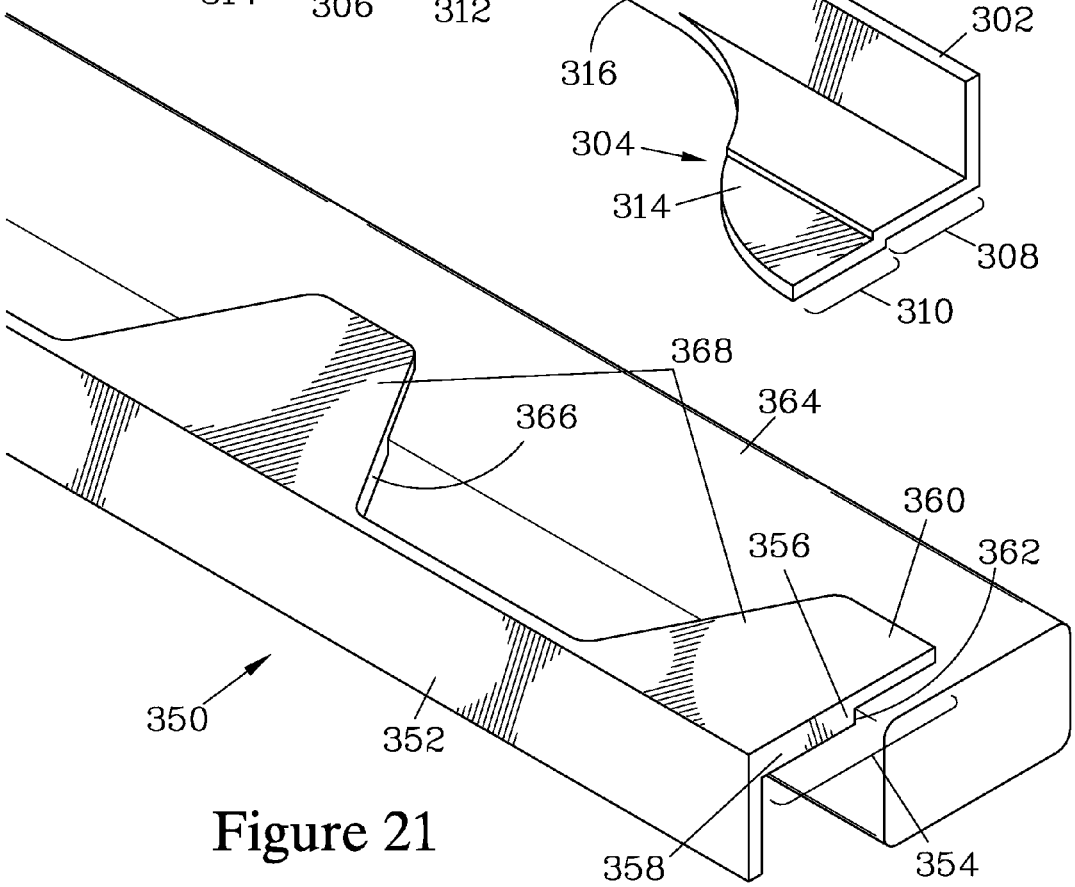
FIG. 21 is an isometric view of another embodiment of the present invention, a frame extender which employs a step as an indexing mark. This embodiment has mounting tabs which are substantially trapezoidal in shape. Compared to the mounting tabs of the embodiment shown in FIG. 6, the mounting tabs of this embodiment are reduced in size and more widely spaced to reduce the amount of material used and to reduce the cross section available for thermal bridging.

FIG. 21 is an isometric view illustrating yet another embodiment of the present invention, a frame extender 350. The frame extender 350 again has a short leg 352 and a long leg 354. In the frame extender 350, an indexing mark is provided by a step 356 in the long leg 354. The step 356 divides the long leg 354 into a proximal region 358 and a distal region 360, where the proximal region 358 has a greater thickness than the distal region 360. The step 356 further provides a ledge surface 362 that can be placed against a structural member 364.

The long leg 354 of this embodiment terminates in a serrated edge 366, which traverses the step 356 and which forms a series of mounting tabs 368 that are substantially trapezoidal. Compared to the mounting tabs 28" of the frame extender 10" shown in FIG. 6, the mounting tabs 368 are smaller and more widely spaced to reduce the cross section for thermal bridging.

These structures are well suited for fabrication using a variety of techniques such as described above. In all these methods, a shaped body is formed so as to have a base extension and a first end member, and the shaped body is provided with an indexing mark that is spaced apart from and parallel to the first end member. Preferably, the indexing mark is formed as a discontinuity in the base extension, and is formed as the shaped body is formed. In a preferred method, the frame extenders are formed as pairs by first forming a shaped body having a base extension bounded by a first end member and a second end member, and then cutting the base extension along a serpentine path to form two frame extenders, each having a portion of the base extension extending from one of the end members so as to provide a structure with a generally L-shaped cross section.

While the novel features of the present invention have been described in terms of particular embodiments and preferred applications, it should be appreciated by one skilled in the art that substitution of materials and modification of details obviously can be made without departing from the spirit of the invention, which is to be limited only by the following claims.

What we claim is:

1. A frame extender for studs and other structural framing members, the frame extender comprising:

an L-shaped body having, a short leg providing a mounting surface to which a wall surfacing material can be attached, a long leg having a mating surface for fastening to a structural framing member, said long leg joining to said short leg along one side thereof and said long leg terminating in a serrated edge, so as to provide a toothed profile, and an indexing mark forming a substantially continuous ledge surface on said long leg that is parallel to said short leg and spaced apart therefrom positioned so as to form, in combination with said mating surface, a cradle for engaging the structural framing member to assure that said short leg extends parallel thereto and is spaced apart therefrom, said ledge surface traversing said toothed profile of said long leg and positioned so as to define, a distal region of said long leg extending beyond said ledge surface opposite said short leg to provide said mating surface for fastening to the structural framing member and, a proximal region of said long leg joining to said short leg, whereby said toothed profile forms a series of mounting tabs of said long leg and said index mark is segmented, having a segment on each of said mounting tabs, and said index mark being so positioned as to provide said ledge surface on said long leg positioned so as to project onto said short leg when said short leg is defined to extend fully across said L-shaped body, with said long leg attached thereto.

2. The frame extender of claim 1 wherein said serrated edge is defined by a serpentine curve.

3. The frame extender of claim 2 wherein said serpentine curve has a periodicity of about eight inches.

4. The frame extender of claim 1 wherein said L-shaped body is fabricated from a material having low thermal conductivity selected from the group of:

plastic, and a particulate material in a binder.

5. The frame extender of claim 4 wherein said material consists essentially of a polymer binder and a particulate matter selected from the group of:

wood particles;

straw particles;

wood fibers; and straw fibers.

6. The frame extender of claim 5 further comprising:

a magnetically-detectable material incorporated into said L-shaped body.

7. The frame extender of claim 1 further comprising:

an extension of said L-shaped body so as to form an X-shaped body, said extension having, a secondary short leg which joins said short leg along one side thereof and is positioned at a right angle thereto, a secondary long leg for fastening to a structural framing member, said long leg joining to said secondary short leg along one side thereof so as to extend at a right angle to said long leg, said secondary long leg terminating in a secondary long leg serrated edge that provides a toothed profile to form a series of mounting tabs of said secondary long leg, and a secondary indexing mark on said secondary long leg that is parallel to said secondary short leg and spaced apart therefrom, said secondary indexing mark traversing said toothed profile of said secondary long leg.

8. A frame extender for studs and other structural framing members, the frame extender comprising:

an L-shaped body having, a short leg providing a mounting surface to which a wall surfacing material can be attached, a long leg for fastening to a structural framing member, said long leg joining to said short leg along one side thereof and having a mating surface for placement against the structural framing member, thereby providing a cradle for engaging the structural framing member, wherein said long leg terminates in a serrated edge so as to provide a toothed profile to form a series of mounting tabs of said long leg; and a segmented indexing mark on said long leg that forms a substantially continuous ledge surface that traverses said toothed profile and extends across said mounting tabs along a plane parallel to said short leg and spaced apart therefrom so as to define, a proximal region of said long leg joining to said short leg, and a distal region of said long leg extending beyond said ledge surface opposite said short leg to provide said mating surface for fastening to the structural framing member, such that when said ledge surface and said mating surface are placed against the structural framing member, said short leg is parallel to a surface of the structural framing member and spaced apart therefrom and a portion of each of said mounting tabs extends beyond the structural framing member.

9. The frame extender of claim 8 wherein said serrated edge is defined by a serpentine curve.

10. The frame extender of claim 9 wherein said serpentine curve includes a series of straight segments.

11. The frame extender of claim 9 wherein said serpentine curve forms a series of sinusoidally-shaped mounting tabs.

12. The frame extender of claim 9 wherein said serpentine curve forms a series of substantially trapezoidal mounting tabs.

13. The frame extender of claim 8 wherein said ledge surface is provided by a ridge protruding from said mating surface.

14. The frame extender of claim 8 wherein said ledge surface is provided by a step in said long leg.

15. The frame extender of claim 8 wherein said ledge surface is positioned such that, when said ledge surface and said mating surface are placed against the structural framing member, a mounting surface of said short leg is spaced about two inches from the surface of the structural framing member.

16. The frame extender of claim 8 wherein said L-shaped body is fabricated from a material having low thermal conductivity selected from the group of:

plastic, and a particulate material in a binder.

17. The frame extender of claim 16 wherein said material consists essentially of a polymer binder and a particulate matter selected from the group of:

wood particles;

straw particles;

wood fibers; and straw fibers.

18. A frame extender for studs and other structural framing members, the frame extender comprising:

an L-shaped body having, a short leg providing a mounting surface to which a wall surfacing material can be attached, a long leg having a mating surface for fastening to a structural framing member, said long leg joining to said short leg along one side thereof and terminating in a serrated outer edge that provides a toothed profile, and a jog in said long leg, said jog traversing said toothed profile and extending parallel to and spaced apart from said short leg so as to define, a distal region of said long leg extending beyond said jog opposite said short leg to provide said mating surface, and a proximal region of said long leg joining to said short leg, said jog forming a ledge surface which, in combination with said mating surface of said long leg, forms a cradle for engaging a structural framing member, said ledge surface being positioned so as to project onto said short leg when said short leg is defined to extend fully across said L-shaped body, with said long leg attached thereto.

19. The frame extender of claim 18 wherein said jog defines a distal region of said long leg which is spaced apart from said short leg and is positioned such that at least a portion of said distal region does not project onto said short leg.

20. The frame extender of claim 19 wherein said serrated edge is defined by a serpentine curve.

* * * * *